US011939134B2

(12) United States Patent
Velliquette

(10) Patent No.: US 11,939,134 B2
(45) Date of Patent: Mar. 26, 2024

(54) PACKAGING FILLER INSERT FOR STACKED WASHER/DRYER UNIT

(71) Applicant: Green Bay Packaging, Inc., Green Bay, WI (US)

(72) Inventor: Jeremy Velliquette, Gibsonburg, OH (US)

(73) Assignee: Green Bay Packaging, Inc., Green Bay, WI (US)

( * ) Notice: Subject to any disclaimer, the term of this patent is extended or adjusted under 35 U.S.C. 154(b) by 137 days.

(21) Appl. No.: 17/379,297

(22) Filed: Jul. 19, 2021

(65) Prior Publication Data

US 2022/0048688 A1 Feb. 17, 2022

Related U.S. Application Data

(60) Provisional application No. 63/064,196, filed on Aug. 11, 2020.

(51) Int. Cl.
*B65D 81/05* (2006.01)
*B65D 85/68* (2006.01)

(52) U.S. Cl.
CPC ..... *B65D 81/053* (2013.01); *B65D 85/68* (2013.01); *B65D 2581/051* (2013.01); *B65D 2585/682* (2013.01); *B65D 2585/6855* (2013.01)

(58) Field of Classification Search
CPC B65D 81/053; B65D 85/68; B65D 2581/051; B65D 2585/682; B65D 2585/6855; D06F 29/005
USPC ..... 206/814, 521–594
See application file for complete search history.

(56) References Cited

U.S. PATENT DOCUMENTS 2,177,241 A * 10/1939 Burack ..... B65D 85/48 206/454
4,811,840 A * 3/1989 Muyskens ..... B65D 5/5035 206/320
4,938,350 A * 7/1990 Grigsby ..... B65D 85/68 206/319
5,275,279 A * 1/1994 Grigsby ..... B65D 85/68 206/319
5,307,928 A * 5/1994 Bishop ..... B65D 5/5033 206/320
5,669,496 A * 9/1997 Daniels ..... B65D 77/24 206/320

(Continued)

OTHER PUBLICATIONS

Sears Installation Instructions, P/N 131639100 (9610).

*Primary Examiner* — Chun Hoi Cheung
(74) *Attorney, Agent, or Firm* — Boyle Fredrickson, S.C.

(57) ABSTRACT

A packaging filler insert includes a first packaging filler insert end and a second packaging filler insert end. A first packaging filler insert side extends from the first packaging filler insert end to the second packaging filler insert end and a second packaging filler side extends from the first packaging filler insert end to the second packaging filler insert end. An outer packaging filler insert face has at least one tab, and an inner packaging filler insert face located and positioned opposite from the outer packaging filler face. A pair of filler inserts are positioned between upper and lower portions of an item that is shipped in a carton, to provide support for the upper portion, such as via engagement with corner posts positioned between the filler inserts and adjacent corners of the carton.

19 Claims, 14 Drawing Sheets

(56) References Cited

U.S. PATENT DOCUMENTS

| | | | | |
|---|---|---|---|---|
| 6,357,587 | B1 * | 3/2002 | Melms, Jr. | B65D 85/64 206/326 |
| 7,048,119 | B2 * | 5/2006 | Baechle | B65D 61/00 206/320 |
| 8,061,521 | B1 * | 11/2011 | Lowry | B65D 19/44 206/592 |
| 8,297,492 | B2 * | 10/2012 | Muyskens | B65D 5/5045 229/199 |
| 9,932,163 | B2 * | 4/2018 | Nishijima | F24C 7/10 |
| 10,029,818 | B2 * | 7/2018 | Kelly | B65D 19/44 |
| 10,207,838 | B1 * | 2/2019 | Morrison | B65D 5/5042 |
| 10,294,018 | B2 | 5/2019 | Machande et al. | |
| 10,494,138 | B1 * | 12/2019 | Velliquette | B65D 5/446 |
| 2013/0220866 | A1 * | 8/2013 | Nakamura | B65D 81/113 206/523 |
| 2017/0359862 | A1 * | 12/2017 | Lee | H05B 6/6402 |
| 2018/0134445 | A1 * | 5/2018 | Chezem | B65D 81/054 |

* cited by examiner

PACKAGING FILLER INSERT FOR STACKED WASHER/DRYER UNIT

CROSS-REFERENCE TO RELATED APPLICATION

This application claims the benefit of U.S. provisional patent application Ser. No. 63/064,196 filed Aug. 11, 2020, the entire disclosure of which is hereby incorporated by reference.

BACKGROUND AND SUMMARY

During shipment, products such as appliances can be damaged or broken when the container, within which the product is packaged, is involved in a collision or is dropped. Some products, e.g. a stacked washer and dryer unit, may be especially susceptible to damage due to their unique product configuration. When a stacked washer and dryer unit is placed in a container for transportation, the stacked washer and dryer unit can not only be damaged along the sides when dropped or mishandled, but can also be damaged due to the dryer unit collapsing forward towards the washer unit due to a lack of support for the dryer unit. It is therefore desirable for a stacked washer and dryer unit to provide support for the upper dryer portion of the unit and to provide structure to increase the protection of the product when disposed within a shipping container.

It is an object of the present invention to enable a manufacturer to use a packaging filler insert to better protect a product during shipping and handling. It is another object of the invention, when the product is a stacked washer and dryer unit, to allow a manufacturer to use the packaging filler insert to prevent a dryer unit from collapsing forward towards a washer unit during shipping and handling.

In accordance with a first embodiment of the invention, a packaging filler insert includes a first packaging filler insert end and a second packaging filler insert end, where a first packaging filler insert side extends from the first packaging filler insert end to the second packaging filler insert end and a second packaging filler side extends from the first packaging filler insert end to the second packaging filler insert end. The packaging filler insert further includes an outer packaging filler insert face that has at least one tab, and an inner packaging filler insert face located and positioned opposite from the outer packaging filler face.

In accordance with another aspect of the invention, the second packaging filler insert side of a packaging filler insert includes a first sidewall, a second sidewall, a third sidewall, a fourth sidewall, and a fifth sidewall. The first sidewall extends parallel to the first packaging filler insert side, and the second sidewall extends from the first sidewall at an angle towards both the first packaging filler insert end and the first packaging filler insert side. The third sidewall extends from the second sidewall parallel to the first packaging filler insert side. The fourth sidewall extends perpendicularly from the third sidewall towards the first packaging filler insert side. The fifth sidewall extends from the fourth sidewall at an angle towards the first packaging filler insert end.

In accordance with another aspect of the invention, the packaging filler insert may include at least three tabs. In more detail, the outer packaging filler insert face includes a bottom tab, a second sidewall tab, and a third sidewall tab. The bottom tab is located at the second packaging filler insert end, the second sidewall tab projects from the second sidewall, and the third sidewall tab projects from the third sidewall.

In accordance with yet another aspect of the invention, the packaging filler insert may be formed from a blank having a first main segment, a second main segment, and a third main segment. The first main segment includes at least one segment tab, and the third main segment includes at least one segment tab. The at least one segment tab of the third main segment aligns with the at least one segment tab of the first main segment. The first main segment is folded along a first fold line located between the first main segment and the second main segment. The third main segment is folded along a second fold line located between the third main segment and the second main segment. The at least one segment tab of the first main segment is then secured to the at least one segment tab of the third main segment.

A method of forming a packaging filler insert includes using a blank that has a first main segment, a second main segment, and a third main segment. The first main segment includes a first segment tab, a second segment tab, a third segment tab, and a fourth segment tab. The third main segment includes a primary segment tab, a secondary segment tab, a tertiary segment tab, and a quaternary segment tab. The first main segment is folded along a first fold line, and the third main segment is folded along a second fold line. The first segment tab engages with the primary segment tab and the second segment tab engages with the secondary segment tab. The third segment tab engages with the tertiary segment tab. The fourth segment tab engages with the quaternary segment tab to form the packaging filler insert.

In a second embodiment of the invention, the packaging filler insert includes a first insert sidewall, a second insert sidewall, a third insert sidewall, and a fourth insert sidewall. The first insert sidewall extends parallel to a first packaging filler insert side, and the second insert sidewall extends perpendicularly from the first sidewall away from the first insert sidewall. The third insert sidewall extends from the second insert sidewall at an angle away from the second insert sidewall and towards a second packaging filler insert end. The fourth sidewall extends from the third sidewall parallel to the first packaging filler insert side and towards a second packaging filler insert side.

Another aspect of the invention includes a stacked washer and dryer having washer unit sidewalls and dryer unit sidewalls. The washer unit has a first washer end and a second washer end. The dryer unit has a first dryer end and a second dyer end. The first washer end of the washer unit engages the second dryer end of the dryer unit, and the washer unit and dryer unit are configured to define a space between the first washer end and the second dryer end. A packaging filler insert as summarized above is selectively insertable into the space in such a way that a second packaging filler insert end is adjacent to and abuts the first washer end. An outer packaging filler insert face further extends parallel to the unit sidewalls and an inner packaging filler insert face and also extends parallel to the washer and dryer unit sidewalls.

Other aspects, features and advantages of the invention will become apparent to those skilled in the art from the following detailed description and accompanying drawings. It should be understood, however, that the detailed description and specific examples, while indicating certain embodiments of the present invention, are given by way of illustration and not of limitation. Many changes and modifications may be made within the scope of the present invention without departing from the spirit thereof, and the invention includes all such modifications.

BRIEF DESCRIPTION OF THE FIGURES

A clear conception of the advantages and features constituting the present invention will become more readily apparent by referring to the exemplary, and therefore non-limiting, embodiments illustrated in the drawings accompanying and forming a part of this specification, wherein like reference numerals designate the same elements in the several views.

In the drawings.

Figure 1:
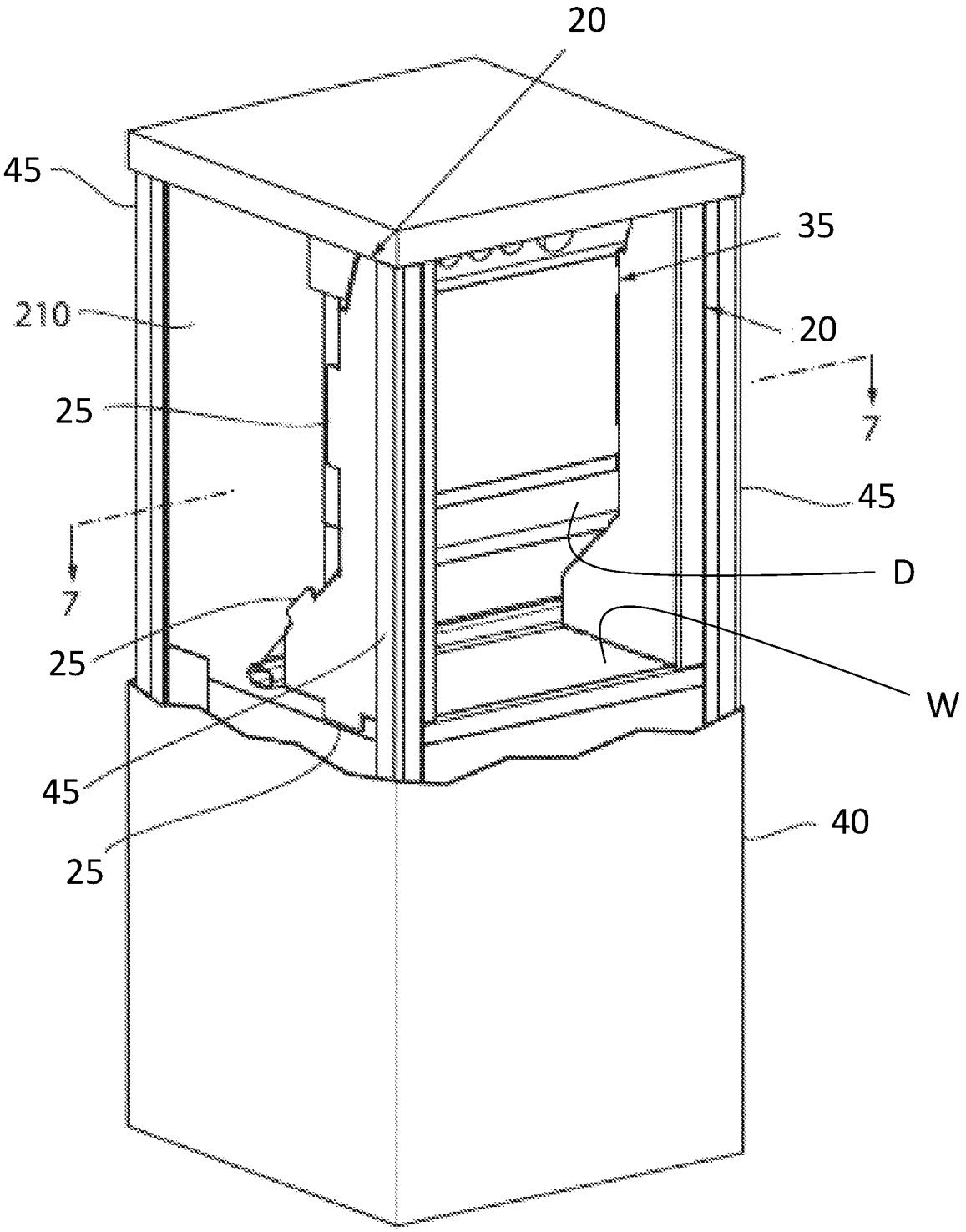
FIG. 1 is a perspective view of a first embodiment of a packaging filler insert in accordance with the present invention, engaged with a stacked washer and dryer unit positioned within a carton that includes reinforcing corner posts for shipping and handling, wherein upper portions of the carton sidewalls are broken away to expose the stacked washer and dryer unit and the packaging filler insert.

In describing the embodiments of the invention which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected," "attached," or terms similar thereto are often used. They are not limited to direct connection or attachment, but include connection or attachment to other elements where such connection or attachment is recognized as being equivalent by those skilled in the art.

DETAILED DESCRIPTION

The present invention and the various features and advantageous details thereof are explained more fully with reference to the non-limiting embodiments described in detail in the following description.

A packaging filler insert 20 in accordance with a first embodiment of the present invention is illustrated in FIG. 1. The packaging filler insert 20 may include a series of tabs 25 and be formed from any material suitable for packaging, such as, but not limited, corrugated board. The packaging filler insert 20 may be inserted and placed onto a product 35 to help support and/or protect the product 35 during transportation. In a representative application, the product 35 may be a stacked washer and dryer unit, although it is contemplated that the packaging filler insert 20 may be used in conjunction with any appliance or relatively large object having an upper portion requiring support, as desired. In embodiments when the product 35 is a stacked washer and dryer unit, the stacked washer and dryer unit includes a washer W and a dryer D.

Once the packaging filler insert 20 is placed between the washer W and dryer D, the product 35 may then be inserted into a container 40. In one embodiment, the container 40 may be a rectangular box. The container 40 may further include a plurality of corner posts 45. The corner posts 45 may be substantially right-angle members or L-like shaped members that extend the height of the container 40. The corner posts 45 are further shaped and sized so that the corner posts 45 may be inserted into each corner of the container 40. The product 35 may be positioned within the container 40 so that a corner of the product 35 is adjacent to and abuts each corner post 45 and a gap 50 (shown in FIG. 7) is therefore left between the product 35 and inner surface of the container 40. The packaging filler insert 20 preferably provides structure and support to the product 35 while within the container 40, and the packaging filler insert 20 is held in its desired positioning within the container 40 because the tabs 25 prevent the packaging filler insert 20 from sliding inwards and towards the center of the container 40, and engagement of the packaging filler insert 20 with the corner post 45 prevents the packaging filler insert 20 from sliding outwardly.

Figure 2:
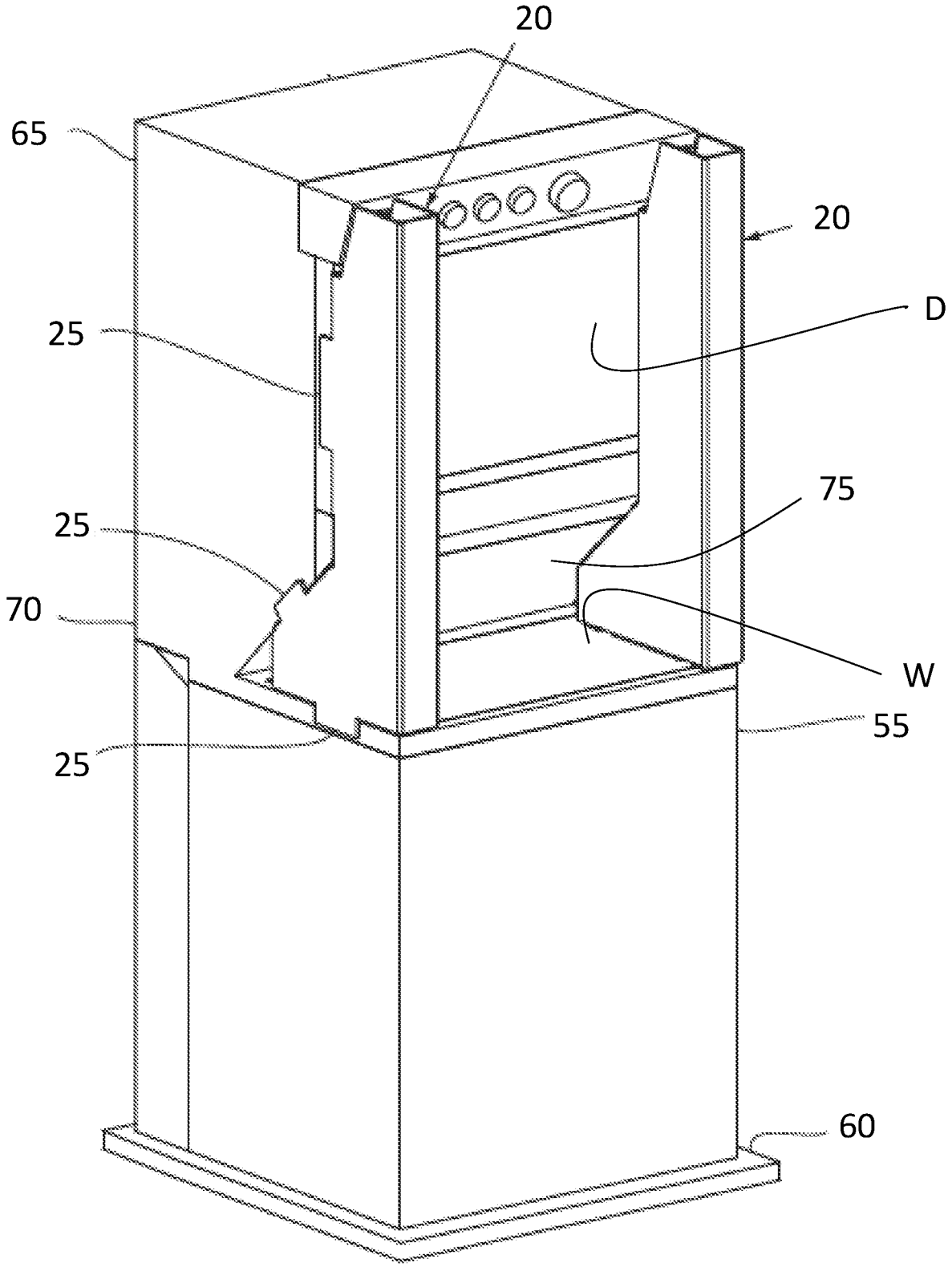
FIG. 2 is a first perspective view of the first embodiment of the packaging filler insert engaged with a stacked washer and dryer unit of FIG. 1, removed from the packaging carton.
Figure 3:
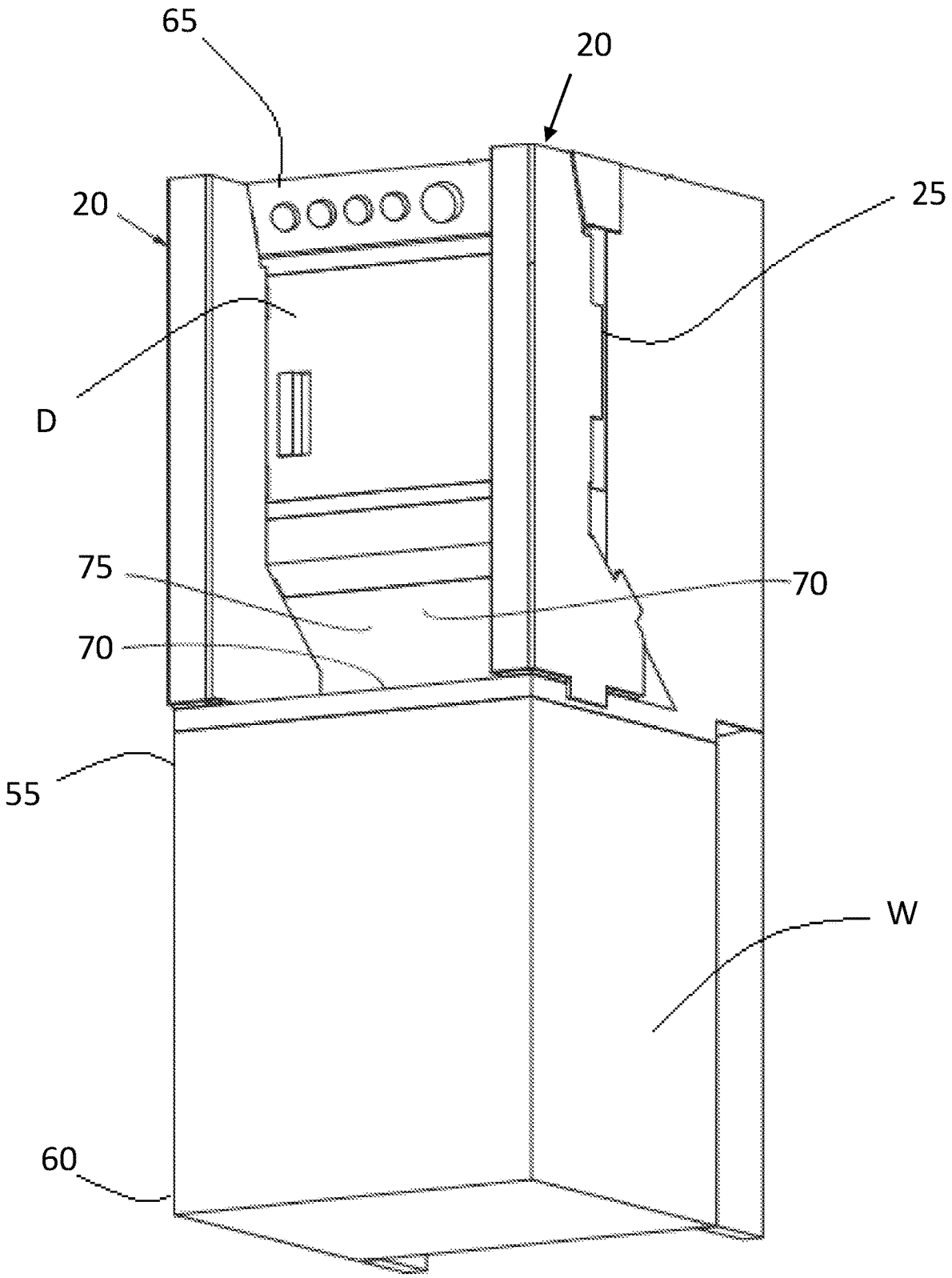
FIG. 3 is a second perspective view of the first embodiment of the packaging filler insert engaged with the stacked washer and dryer unit of FIGS. 1 and 2, removed from the packaging carton.
Figure 4:
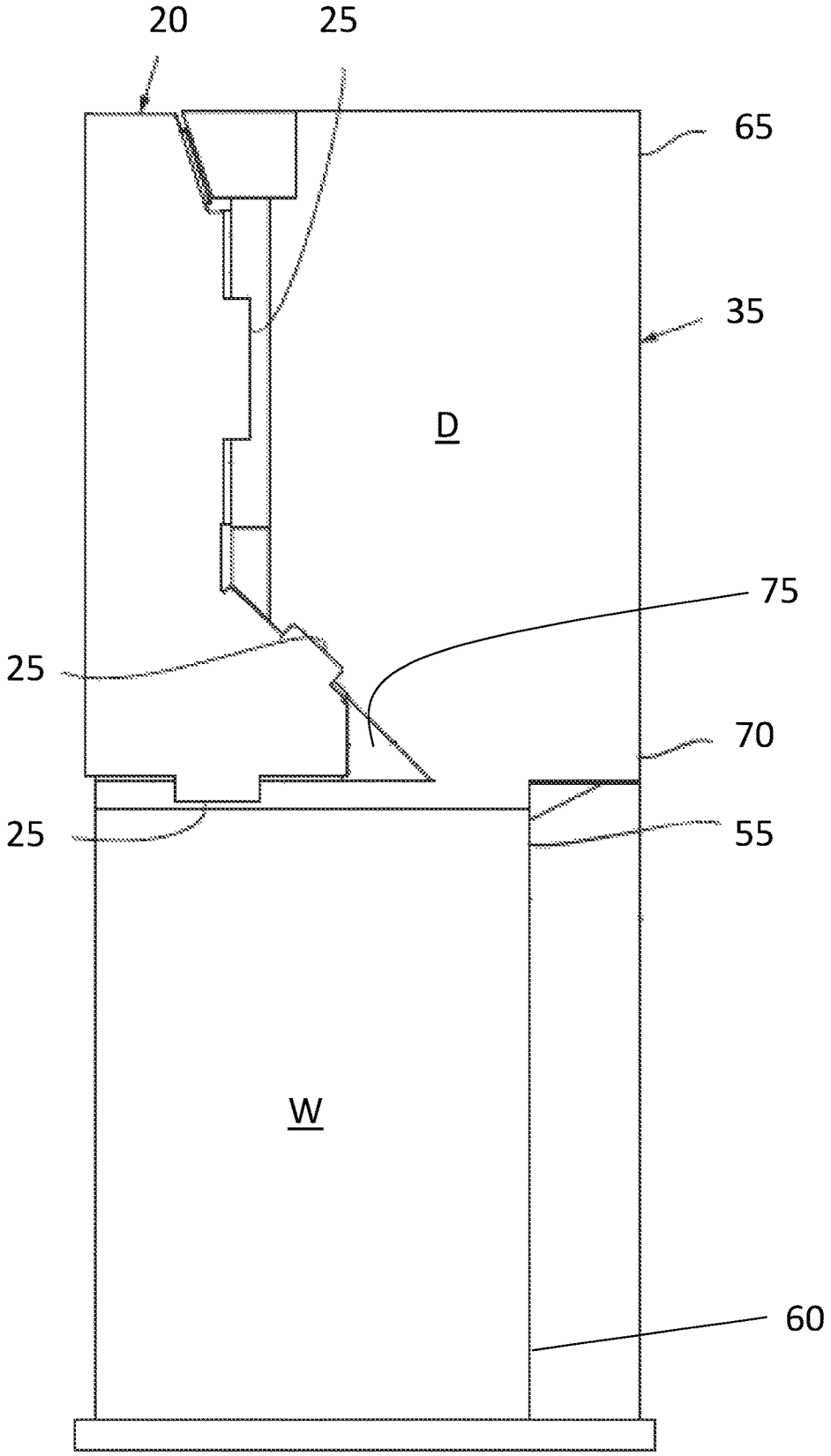
FIG. 4 is a side elevation view of the first embodiment of the packaging filler insert engaged with the stacked washer and dryer unit of FIGS. 1-3.

Turning to FIGS. 2-4, when the product 35 is a stacked washer and dryer unit, the washer W includes a first washer end 55 and a second washer end 60, while the dryer D includes a first dryer end 65 and a second dyer end 70. The first washer end 55 of the washer W is interconnected with the second dryer end 70 of the dryer D. The washer W and dryer D are configured such that an irregular space 75 is defined above the first washer end 55 and forwardly of the dryer D. and the packaging filler insert 20 is configured to be inserted into the irregular space 75 defined above the washer W and forwardly of the dryer D.

The packaging filler insert 20 is positioned between the washer W and dryer D and is retained in this position during shipping and handling. The tabs 25 of the packaging filler insert 20 are adjacent to and abut a unit sidewall 80 of the product 35. The packaging filler insert 20 may include a greater or fewer number of tabs 25 than as shown in FIGS. 2-4. Once the packaging filler insert 20 is engaged above the washer W and forwardly of the dryer D of the product 35, the packaging filler insert 20 helps support the upper portion of the product 35 (e.g., the upper dryer portion of the stacked washer and dryer unit) during shipping and handling.

Figure 5:
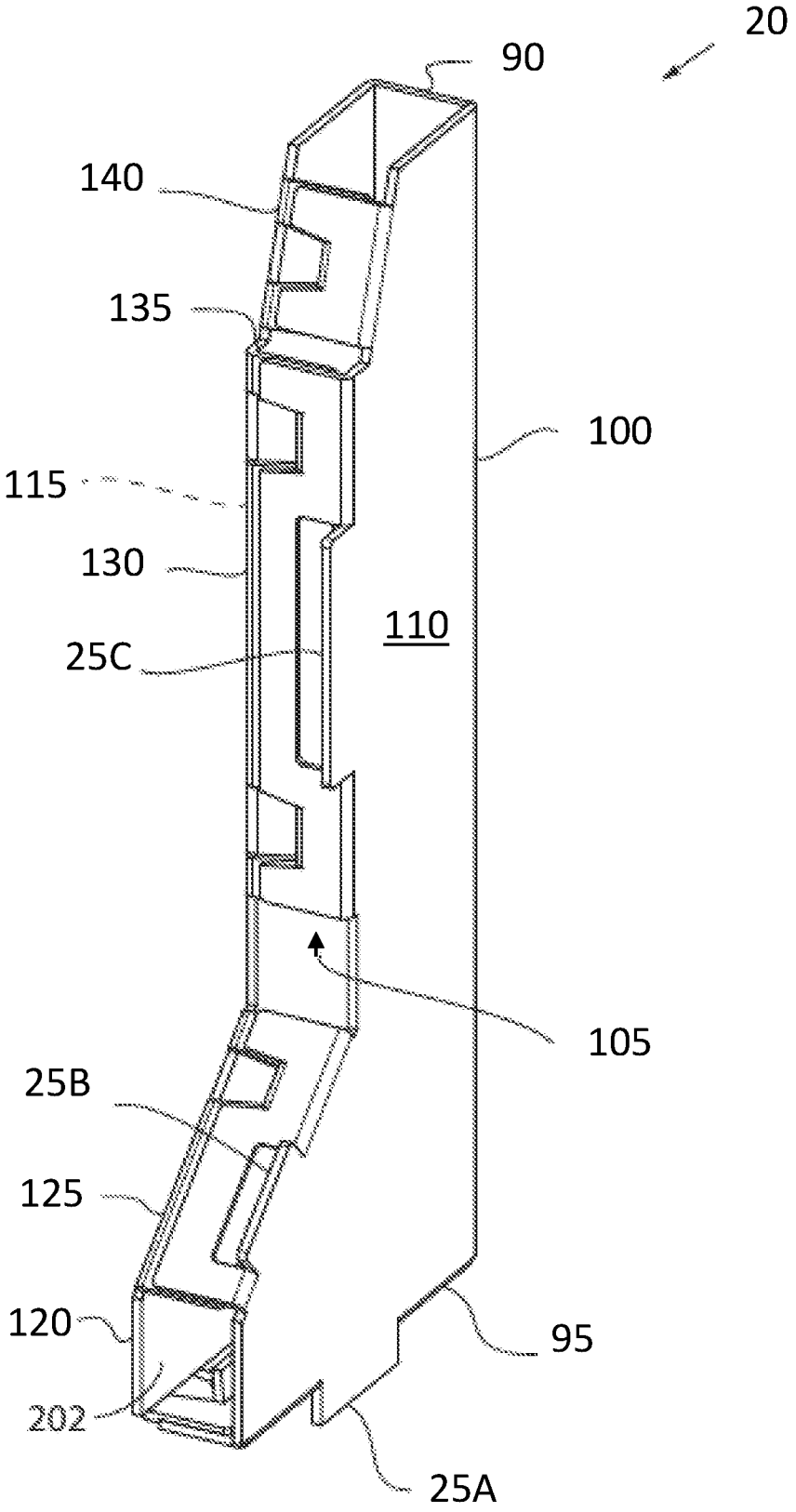
FIG. 5 is a perspective view of the first embodiment of a packaging filler insert as shown in FIGS. 1-4.
Figure 6:
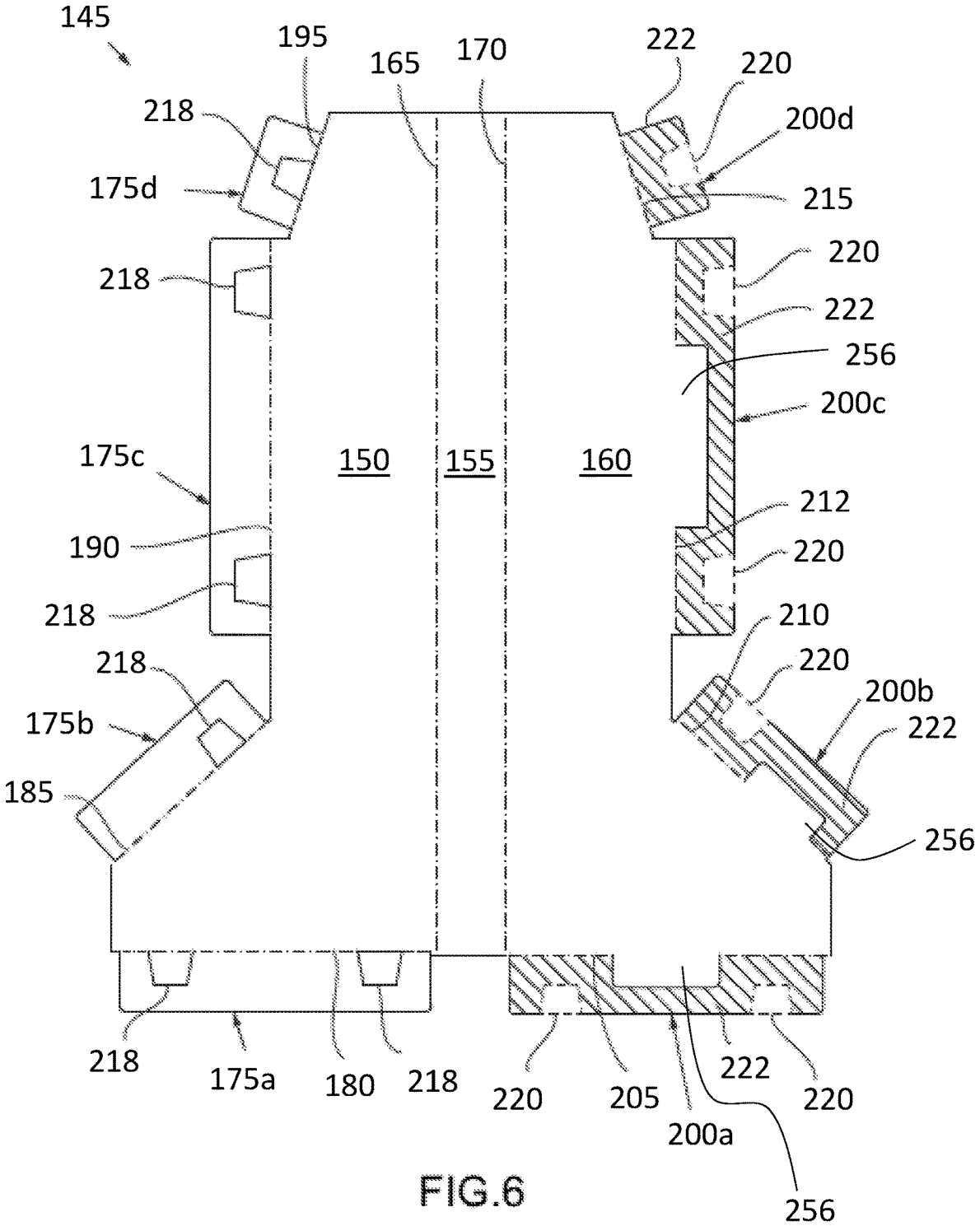
FIG. 6 is a plan view of a blank from which the first embodiment of the packaging filler insert of FIGS. 1-5 is constructed.

As illustrated in FIGS. 5 and 6, a first embodiment of the left packaging filler insert 20 (i.e., the packaging filler insert 20 that is placed on the left side of the product 35) is shown and will be described, with the understanding that the right packaging filler insert 20 is a mirror image. The packaging filler insert 20 includes a first packaging filler insert end 90 and a second packaging filler insert end 95, as well as a first packaging filler insert side 100 and a second packaging filler insert side 105. The packaging filler insert filler insert 20 further includes an outer packaging filler insert face 110 and an inner packaging filler insert face 115.

The first packaging filler insert side 100 extends from the first packaging filler insert end 90 towards the second packaging filler insert end 95 in a substantially straight line. The first packaging filler insert side 100 is further substantially perpendicular to the first packaging filler insert end 90, outer packaging filler insert face 110, inner packaging filler insert face 115, and second packaging filler insert end 95. In this embodiment, the second packaging filler insert side 105 may extend perpendicularly from the second packaging filler insert end 95 towards the first packaging filler insert end 90, substantially parallel to the first packaging filler insert side 100 to form a first sidewall 120. The second packaging filler insert side 105 preferably includes a portion that extends at an angle, which may representatively be a substantially 45° angle or otherwise as dictated by the configuration of the lower surface of the dryer unit D, from the first sidewall 120 inwards towards both the first packaging filler insert end 90 and the first packaging filler insert side 100, forming a second sidewall 125. In alternative embodiments, the second sidewall 125 may extend from the first sidewall 120 at a greater or lesser angle. The second packaging filler insert side 105 continues to extend from the second sidewall 125 to form a third sidewall 130. The third sidewall 130 extends from the second sidewall 125 at an angle so that the third sidewall 130 extends towards the first packaging filler insert end 90 substantially parallel to the first packaging filler insert side 100. The second packaging filler insert side 105 further includes a fourth sidewall 135 that extends substantially perpendicularly from the third sidewall 130 towards the first packaging filler insert side 100. Finally, the second packaging filler insert side 105 includes a fifth sidewall 140 that extends from the fourth sidewall 135 towards the first packaging filler insert end 90 at an angle, which may representatively be a substantially 75° angle or otherwise as dictated by the configuration of the upper surface of the dryer unit D. In alternative embodiments, the first and second packaging filler insert sides 100 and 105 may have greater or fewer sidewalls, or sidewalls 120-140 may extend at different angles.

In this embodiment, the packaging filler insert 20 may further include at least one tab 25. Representatively, the packaging filler insert 20 may include three tabs 25—a bottom tab 25A, a second sidewall tab 25B, and a third sidewall tab 25C. The bottom tab 25A, second sidewall tab 25B, and third sidewall tab 25C may be rectangular members that are located and positioned at and further extend from the outer packaging filler insert face 110. However, the bottom tab 25A, second sidewall tab 25B, and third sidewall tab 25C may be other shapes in alternative embodiments. The bottom tab 25A may be further located at the second packaging filler insert end 95, opposite to the first packaging filler insert end 90, while the second sidewall tab 25B projects from the second sidewall 125. The third sidewall tab 25C may project from the third sidewall 130. The packaging filler insert 20 may further include no sidewall tabs, a lesser number of sidewall tabs, or a greater number of sidewall tabs in alternative embodiments.

Next, FIG. 6 illustrates a top view of a blank 145 used to manufacture the packaging filler insert 20. The blank 145 of this embodiment includes three (3) main segments 150, 155, 160. First main segment 150 and second main segment 155 are divided by a first fold line 165, while the second main segment 155 and third main segment 160 are divided by a second fold line 170. The first main segment 150 includes at least one segment tab 175. In which, the illustrated embodiment, includes a first segment tab 175*a*, a second segment tab 175*b*, a third segment tab 175*c*, and a fourth segment tab 175*d*. The first segment tab 175*a* is divided from the first main segment 150 by a third fold line 180. The second segment tab 175*b* is divided from the first main segment 150 by a fourth fold line 185, while the third segment tab 175*c* is divided from the first main segment 150 by a fifth fold line 190. Finally, the fourth segment tab 175*d* is divided from the first main segment 150 by a sixth fold line 195.

Similarly, the third main segment 160 includes a at least one segment tab which, in the illustrated embodiment, includes a primary segment tab 200*a*, a secondary segment tab 200*b*, a tertiary segment tab 200*c*, and a quaternary segment tab 200*d*. The primary segment tab 200*a* is divided from the third main segment 160 by a seventh fold line 205. The secondary segment tab 200*b* is divided from the third main segment 160 by an eighth fold line 210, while the tertiary segment tab 200*c* is divided from the third main segment 160 by a ninth fold line 212. Finally, the quaternary segment tab 200*d* is divided from the third segment 160 by a tenth fold line 215. In alternative embodiments, the number of segment tabs such as 175*a*-175*c* and 200*a*-200*d* may differ according to the number of sidewalls of the second packaging filler side 105, as will be explained hereinafter.

The first segment tab 175*a*, second segment tab 175*b*, third segment tab 175*c*, and fourth segment tab 175*d* may each include at least one segment void 218. In the illustrated embodiment, the first segment tab 175*a* and third segment tab 175*c* each includes two segment voids 218, while the second segment tab 175*b* and fourth segment tab 175*d* each includes one segment void 218. In this embodiment, each segment void 218 is shaped as an isosceles trapezoid, although segment voids 218 may be shaped otherwise in alternative embodiments. Similarly, the primary segment tab 200*a*, secondary segment tab 200*b*, tertiary segment tab 200*c*, and quaternary segment tab 200*d* may also each include at least one perforated tab 220. Each perforated tab 220 may be formed by perforations along the side of each perforated tab 220 and an inner perforated tab fold line, located between each perforation. Like the segment void 218, each perforated tab 220 may also be shaped as an isosceles trapezoid, but may be alternative shapes in other embodiments.

In this embodiment, the primary segment tab 200*a* and tertiary segment tab 200*c* each includes two perforated tabs 220, while the secondary segment tab 200*b* and quaternary segment tab 200*d* each includes a single perforated tab 220. The invention is not limited to the first segment tab 175*a* and third segment tab 175*c* each having two segment voids 218 or the primary segment tab 200*a* and tertiary segment tab 200*c* each having two perforated tabs 220. The invention is further not limited to the second segment tab 175*b* and fourth segment tab 175*d* each having a single segment void 218, or the secondary segment tab 200*b* and quaternary segment tab 200*d* each having a single perforated tab 220. In alternative embodiments, the first segment tab 175*a*, second segment tab 175*b*, third segment tab 175*c*, and fourth segment tab 175*d* may each include zero, one, two, or more segment voids 218. Similarly, the primary segment tab 200*a*, secondary segment tab 200*b*, tertiary segment tab 200*c*, and quaternary segment tab 200*d* may each include zero, one, two, or more perforated tabs 220.

To form the packaging filler insert 20, the first main segment 150 is folded perpendicularly to the second main segment 155 along the first fold line 165. As a result, the first segment 85 is folded at approximately a 90° angle in order to be perpendicular to the second main segment 155. The third main segment 160 is further folded perpendicularly to the second main segment 155 along the second fold line 170. As a result, the third segment 95 is folded at approximately a 90° angle in order to be perpendicular to the second main segment 155 and approximately parallel to the first main segment 150.

The first segment tab 175*a*, second segment tab 175*b*, third segment tab 175*c*, and fourth segment tab 175*d* are also folded along the third fold line 180, fourth fold line 185, fifth fold line 190, and sixth fold line 195, respectively. As a result, the first segment tab 175*a*, second segment tab 175*b*, third segment tab 175*c*, and fourth segment tab 175*d* are folded at approximately a 90° angle in order to be perpendicular to the first main segment 150, and second segment tab 175*b*, third segment tab 175*c*, and fourth segment tab 175*d* located opposite from the second main segment 155. The primary segment tab 200*a*, secondary segment tab 200*b*, tertiary segment tab 200*c*, and quaternary segment tab 200*d* are folded along the seventh fold line 205, eighth fold line 210, ninth fold line 212, and tenth fold line 215, respectively. As a result, the primary segment tab 200*a*, secondary segment tab 200*b*, tertiary segment tab 200*c*, and quaternary segment tab 200*d* are folded at approximately a 90° angle perpendicular to the third main segment 160 and adjacent to the first segment tab 175*a*, second segment tab 175*b*, third segment tab 175*c*, and fourth segment tab 175*d*, respectively.

Once folded, the first main segment 150 becomes the inner packaging filler insert face 115, the second main segment 155 becomes the first packaging filler insert side 100, the third main segment 160 becomes the outer packaging filler insert face 110, the segment tabs 175*b*-175*d* and 200*b*-200*d* become the second packaging tiller insert side 105, and the segment tabs 175*a* and 200*a* become the second packaging filler insert end 95 as shown in FIG. 5.

In this embodiment, a first adhesive 222 is applied to the primary segment tab 200*a*. The first adhesive 222 is further applied to the secondary segment tab 2001, the tertiary segment tab 200*c*, and the quaternary segment tab 200*d*. The first adhesive 222 is configured to adhere the primary segment tab 200*a* to the first segment tab 175*a* when the first main segment 150 is folded along the first fold line 165 and the third main segment 160 is folded along the second fold line 170. The first adhesive 222 is further configured to adhere the secondary segment tab 200*b* to the second segment tab 175*b*, tertiary segment tab 200*c* to the third segment tab 175*c*, and quaternary segment tab 200*d* to the fourth segment tab 175*d* when the first and third main segments 150, 160 and segment tabs 175*a*-175*d* and 200*a*-200*d* are folded along their respective fold lines 165-170, 180-195, and 205-215. Further alternative embodiments of the invention may use other means to secure the primary segment tab 200*a* to the first segment tab 175*a*, the secondary segment tab 200*b* to second segment tab 175*b*, the tertiary segment tab 200*c* to the third segment tab 175*c*, and the quaternary segment tab 200*d* to the fourth segment tab 175*d*, such as, but not limited to, tape, tabs, staples or other suitable fasteners. These alternative means may be used alone or in conjunction with the first adhesive 222.

In embodiments when the first segment tab 175*a*, second segment tab 175*b*, third segment tab 175*c*, and fourth segment tab 175*d* include segment voids 218, and the primary segment tab 200*a*, secondary segment tab 200*b*, tertiary segment tab 200*c*, and quaternary segment tab 200*d* also include perforated tabs 220, the segment voids 218 align with the perforated tabs 220 when the segment tabs 175*a*-175*d* and 200*a*-200*d* are folded along fold lines 180-195, and 205-215. The segment voids 218 may be used in conjunction with the perforated tabs 220 to secure the primary segment tab 200*a* to the first segment tab 175*a*, the secondary segment tab 200*b* to the second segment tab 175*b*, the tertiary segment tab 200*c* to the third segment tab 175*c*, and the quaternary segment tab 200*d* to the fourth segment tab 175*d*. In this embodiment, each perforated tabs 220 is folded inwards and through its aligned segment void 218. As a result, the perforated tabs 220 remains within a cavity 225 (shown in FIG. 5) of the packaging filler insert 20 due to its isosceles trapezoid-like shape and holds the segment tabs 175, 200 in position relative to each other. The segment voids 218 and perforated tabs 220 preferably ensure the packaging filler insert 20 retains its shape and form once it has been folded along its fold lines 165-170, 180-195, and 205-215.

Figure 7:
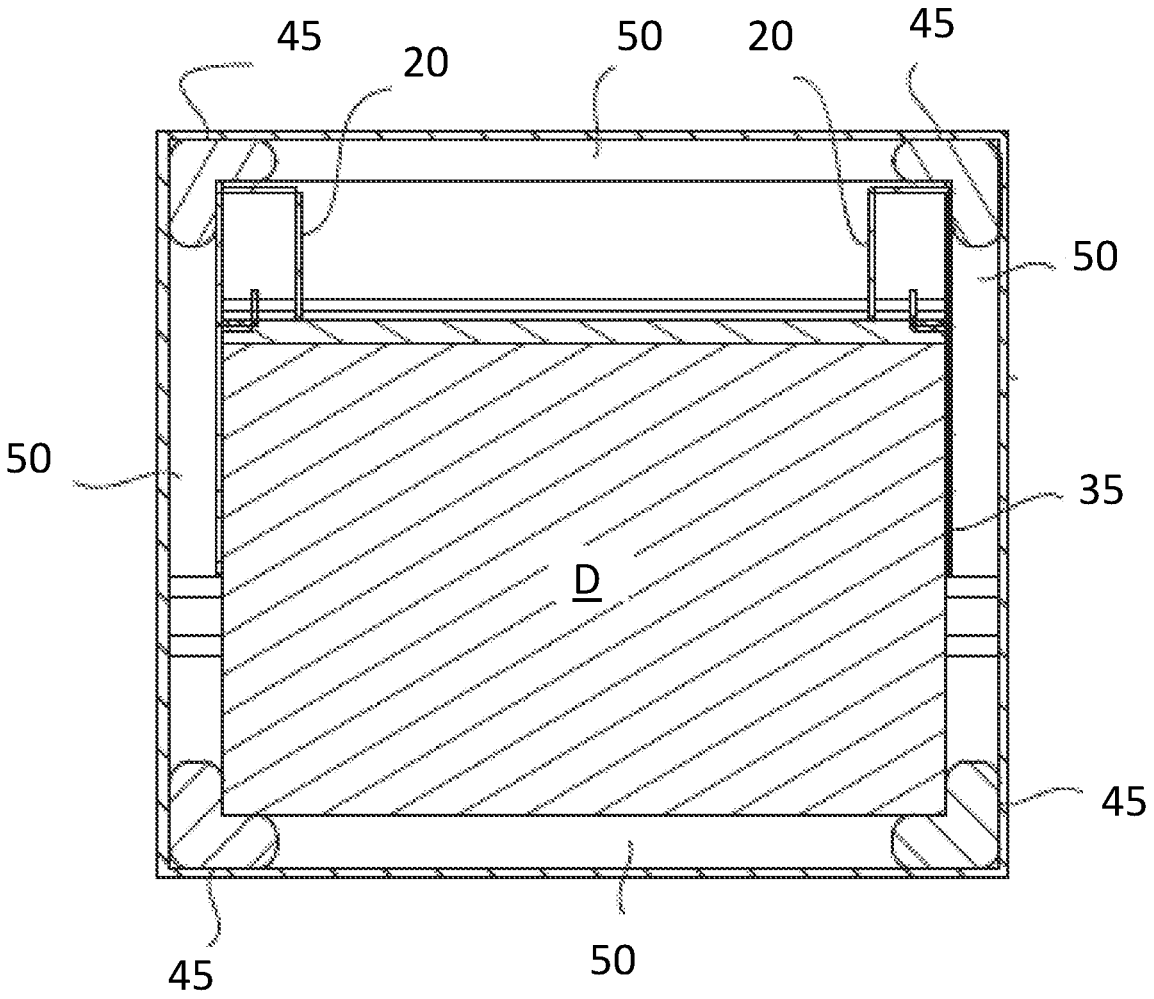
FIG. 7 is a top cross-sectional view of the first embodiment of packaging filler insert engaged with a stacked washer and dryer unit taken at line 7-7 in FIG. 1.

Thus, once the blank 145 has been folded to form the packaging filler insert 20, the packaging filler insert 20 may be placed onto the product 35. In embodiments where the product 35 is a stacked washer and dryer unit, the packaging filler insert 20 may be placed in-between the washer W and dryer D to help protect and support the stacked washer and dryer during shipping. The product 35 may then be placed within the container 40, which preferably further includes corner posts 45 located and positioned in each corner of the container 40 as illustrated in FIG. 7. The product 35 is therefore situated generally in the center of the container 40 in such a way that the product 35 contacts and abuts the corner posts 45 so that gaps 50 are left between the sidewalls of the product 35 and sidewalls of the container 40. The packaging filler insert 20 retains its positioning in the container 40 between the washer W and dryer D because its tabs 25 abut the sidewall of the product and prevent the packaging filler insert 20 from sliding inwards, while the sidewalls of the container prevent the packaging filler insert 20 from sliding in the opposite direction. The packaging filler inserts 20 thus function to provide vertical support from below to the bottom of the dryer unit D from the top of the washer unit W, while at the same time occupying the space forwardly of the front of the dryer unit D to provide horizontal support to the front of the dryer unit D via engagement of the packaging filler inserts 20 with the corner posts 45.

Figure 8:
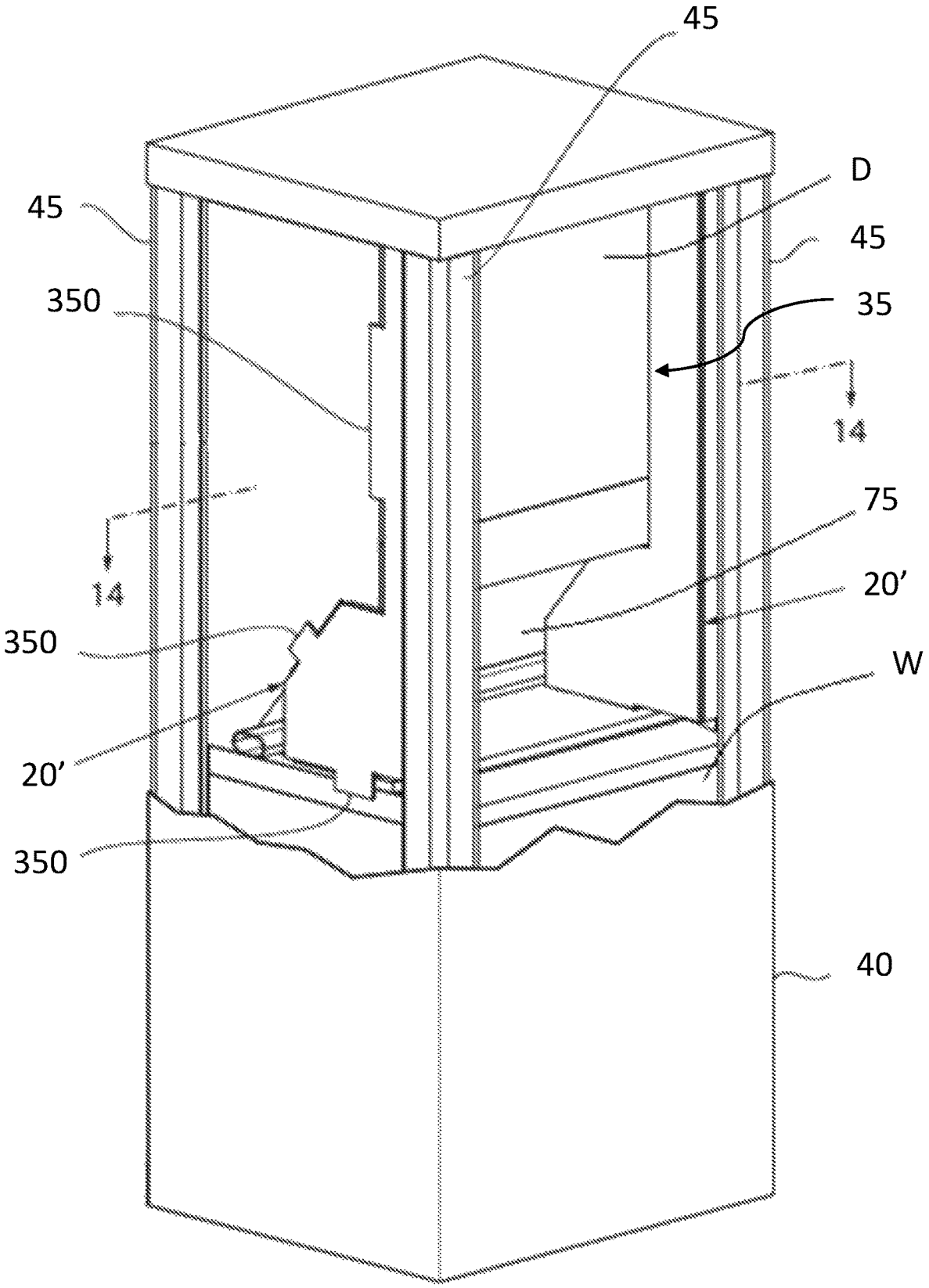
FIG. 8 is a perspective view similar to FIG. 1, showing a second embodiment of a packaging filler insert in accordance with the present invention engaged with a stacked washer and dryer unit.
Figure 9:
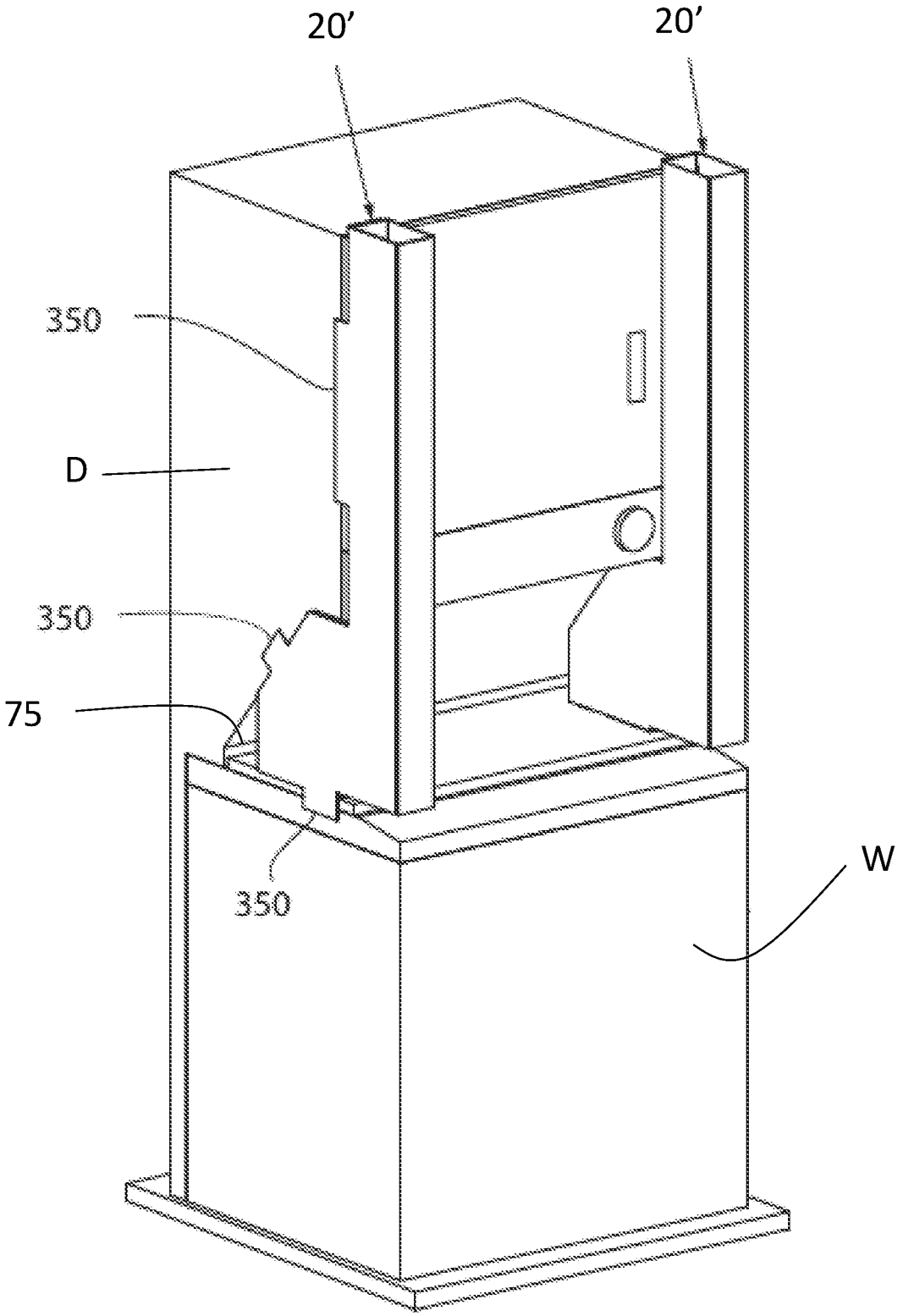
FIG. 9 is a perspective view similar to FIG. 2, showing the second embodiment of the packaging filler insert engaged with a stacked washer and dryer unit as in FIG. 8.
Figure 10:
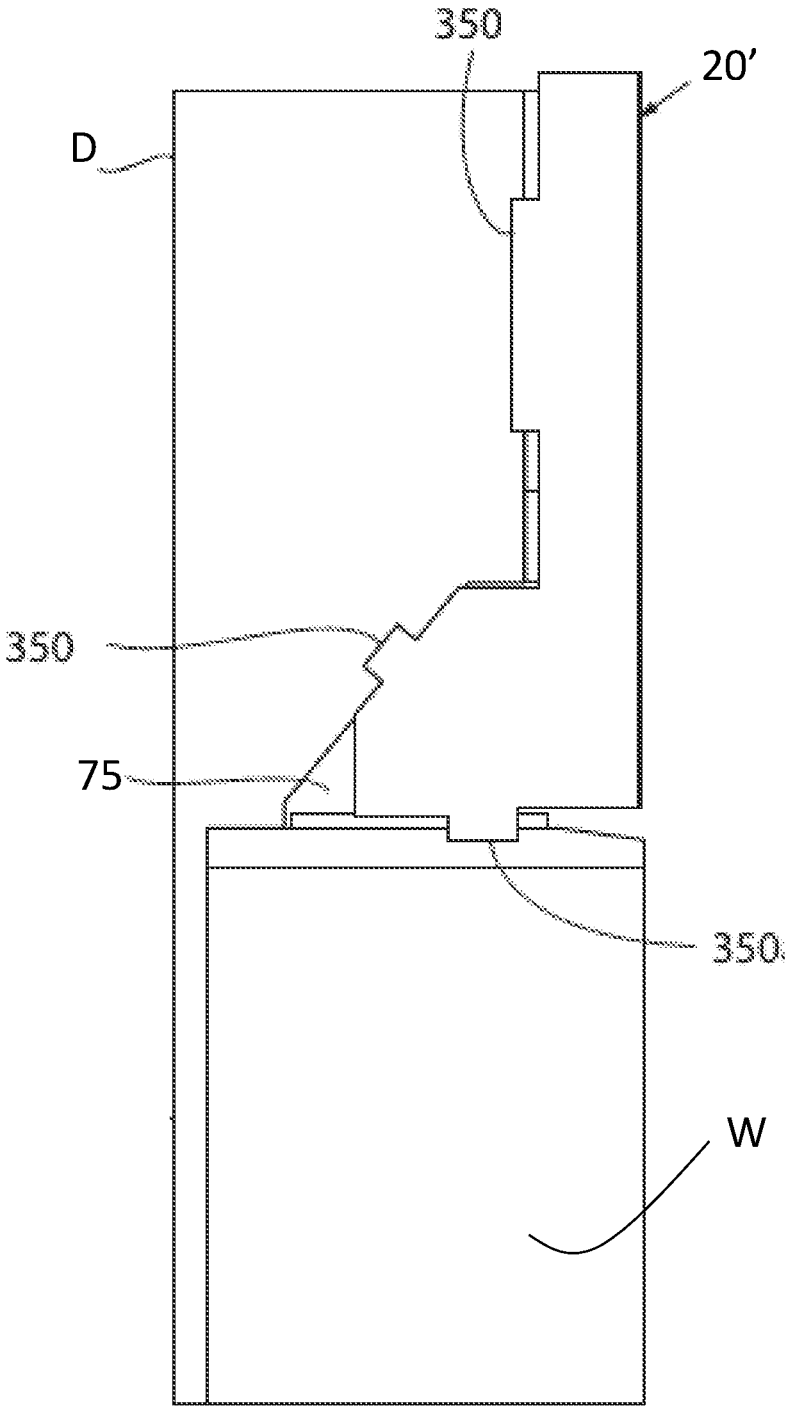
FIG. 10 is a side elevation view of the second embodiment of the packaging filler insert engaged with the stacked washer and dryer unit of FIGS. 8 and 9.

A second embodiment of a packaging insert in accordance with the present invention is shown at 20' in FIGS. 8-10, which again may be formed of any material suitable for packaging, such as, but not limited, corrugated board. As in the first embodiment, the packaging filler insert 20' may also be used with the product 35 by positioning the packaging filler insert 20' on the product 35 to help support and/or protect the product 35 during shipping. The packaging insert 20' configured to be positioned on one side of the product 35 will be described, with the understanding that a mirror image packaging insert is configured to be positioned on the other side of the product 35.

When the product 35 is a stacked washer and dryer, the packaging filler insert 20' is positioned in the space 75 between the washer W and dryer D where its tabs 350 abut the outer wall of the product 35. The packaging filler insert 20' is retained in that position during shipping and handling. Once the packaging filler insert 20' has been placed and positioned on the product 35, the product 35 may be further inserted into the container 40. In one embodiment, the container 40 may be a rectangular box. The container 40 may include corner posts 45 inserted into each corner of the container 40, where each corner post 45 may be a L-like shaped member that extends the height of the container 40. The product 35 may be positioned within the container 40 so that a corner of the product 35 is adjacent to and abuts the corner posts 45 creating the gap 50 between the product 35 and inner surface of the container 40. When the packaging filler insert 20' is engaged with the product 35, the packaging filler insert 20' helps support the upper portion of the product 35 (e.g., the upper dryer portion of a stacked washer and dryer unit) during shipping and handling.

Figure 11:
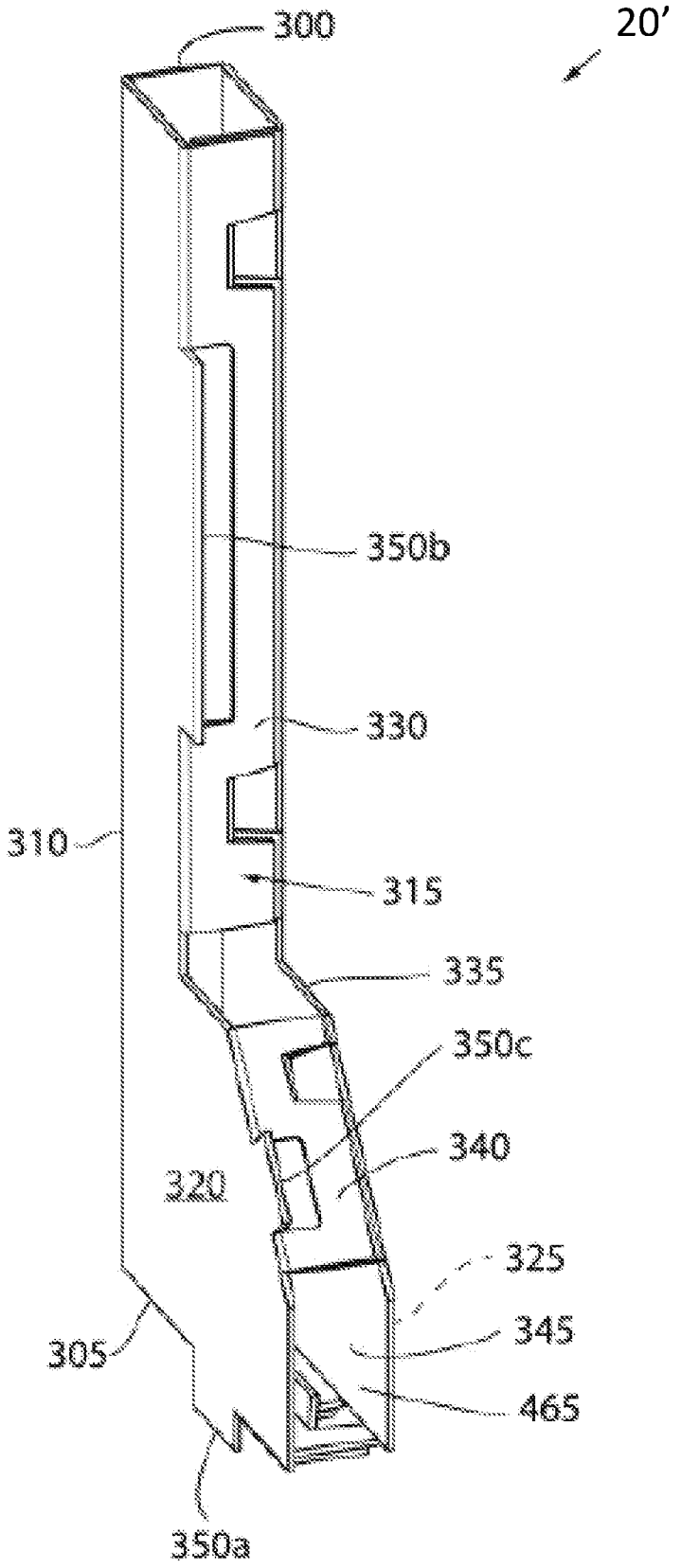
FIG. 11 is a perspective view of the second embodiment of the packaging filler insert of FIGS. 8-10.
Figure 12:
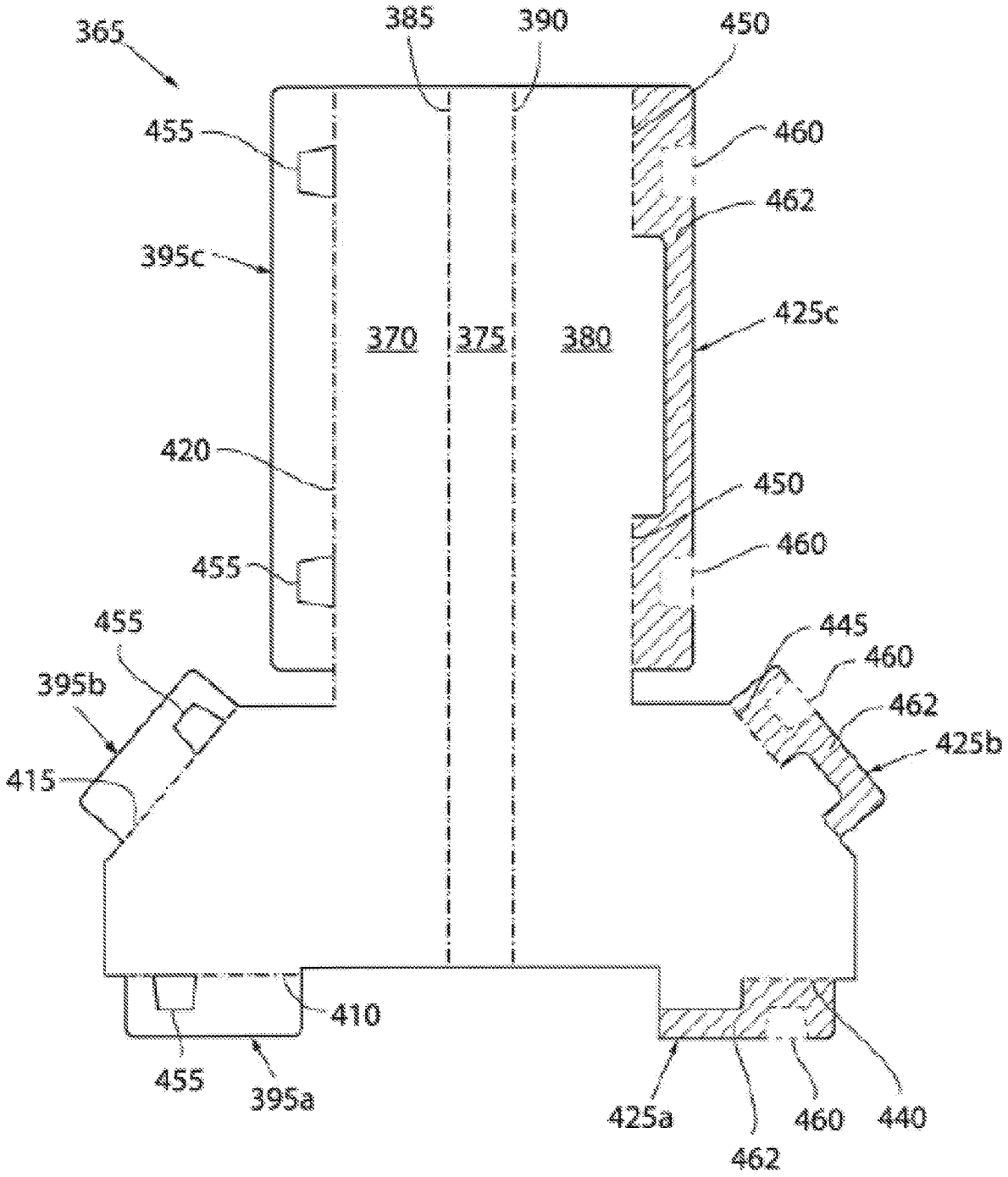
FIG. 12 is a plan view of a blank from which the second embodiment of the packaging filler insert of FIGS. 8-11 is constructed.

As illustrated in FIGS. 11 and 12, a second embodiment of the right packaging filler insert 20' (i.e., that is placed on the right side of the product 35) is shown and will be described, with the understanding that the left packaging filler insert 20' is a mirror image. The second embodiment of the packaging filler insert 20' includes a first packaging filler insert end 300 and a second packaging filler insert end 305. The packaging filler insert 20' further includes a first packaging filler insert side 310 and a second packaging filler insert side 315. The packaging filler insert filler insert 20' also includes an outer packaging filler insert face 320 and an inner packaging filler insert face 325, opposite from the outer packaging filler insert face 320.

The first packaging filler insert side 310 extends from the first packaging filler insert end 300 towards the second packaging filler insert end 305 in a substantially vertical or straight line. The first packaging filler insert side 310 may be further substantially perpendicular to both the first packaging filler insert end 300 and the second packaging filler insert end 305. The first packaging filler insert side 310 is further located and positioned opposite from the second packaging filler insert side 315.

In the second embodiment of the packaging filler insert 20', the second packaging filler insert side 315 extends from the first packaging filler insert end 300 to the second packaging filler insert end 305 and includes a first insert sidewall 330, a second insert sidewall 335, a third insert sidewall 340, and a fourth insert sidewall 345. The first insert sidewall 330 extends from the first packaging filler insert end 300 towards the second packaging filler insert end 305, substantially parallel to the first packaging filler insert side 310. The first insert sidewall 330 then transitions into the second insert sidewall 335, which projects substantially perpendicularly away from the first insert sidewall 330. The second insert sidewall 335 is adjacent to and abuts the third insert sidewall 340. The third insert sidewall 340 extends from the second insert sidewall 335 at an angle, which may representatively be a substantially 45° angle or otherwise as dictated by the configuration of the lower surface of the dryer unit D, away from the first packaging filler insert side 310 and towards the second packaging filler insert end 305. Finally, the fourth insert sidewall 345 extends from third insert sidewall 340 towards the second packaging filler insert end 305, substantially parallel to the first packaging filler insert side 310. In alternative embodiments, the first and second packaging filler insert sides 310 and 315 may have greater or fewer sidewalls or the sidewalls 330-345 may extend at different angles as determined by the configuration of the product 35.

The outer packaging filler face 320 further includes at least one sidewall insert tab, including, representatively and as illustrated in FIG. 11, a bottom sidewall insert tab 350A, a first insert sidewall tab 350B, and a third insert sidewall tab 350C. The bottom sidewall insert tab 350A, first insert sidewall tab 350B, and third insert sidewall tab 350C may be rectangular members that extend from the outer packaging filler face 320. However, the bottom sidewall insert tab 350A, the first insert sidewall tab 350B, and the third insert sidewall tab 350C may be other shapes in alternative embodiments. The bottom sidewall insert tab 350A may further extend from the second packaging filler insert end 305, while the first insert sidewall tab 350B extends from the first insert sidewall 330, and the third insert sidewall tab 350C extends from the third insert sidewall 340.

Turning to FIG. 12, a blank 365 is used to manufacture the second embodiment of the packaging filler insert 20'. The blank 365 of this embodiment includes three (3) main segments 370, 375, 380. The first main segment 370 and second main segment 375 are divided by a first blank fold line 385, while the second main segment 375 and third main segment 380 are divided by a second blank fold line 390. The first main segment 370 includes at least one blank segment tab which, in the illustrated embodiment, includes a first blank segment tab 395*a*, a second blank segment tab 395*b*, and a third blank segment tab 395*c*. The first blank segment tab 395*a* is divided from the first main segment 370 by a third blank fold line 410. The second blank segment tab 395*b* is divided from the first main segment 370 by a fourth blank fold line 415, while the third blank segment tab 395*c* is divided from the first main segment 370 by a fifth blank fold line 420. Similarly, the third main segment 380 also includes at least one blank segment tab which, in the illustrated embodiment, includes a primary blank segment tab 425*a*, a secondary blank segment tab 425*b*, and a tertiary blank segment tab 425*c*. The primary blank segment tab 425*a* is divided from the third main segment 380 by a sixth blank fold line 440. The secondary blank segment tab 425*b* is divided from the third main segment 380 by a seventh blank fold line 445, while the tertiary blank segment tab 425*c* is divided from the third main segment 380 by an eighth blank fold line 450.

The first blank segment tab 395*a*, second blank segment tab 395*b*, and third blank segment tab 395*c* of the first main segment 370 may each include at least one blank segment void 455. In this embodiment, each blank segment void 455 is shaped as an isosceles trapezoid, although the blank segment void 455 may be shaped otherwise in alternative embodiments. The primary blank segment tab 425*a*, secondary blank segment tab 425*b*, and tertiary blank segment tab 425*c* of the third main segment 380 may each include at least one blank segment perforated tab 460. Each perforated tab 460 may be formed by perforations along the side of each perforated tab 460 and an inner perforated tab fold line, located between the two perforations. Each perforated tab 220 may further be shaped as an isosceles trapezoid, but may be alternative shapes in other embodiments.

As seen in FIG. 12, the first blank segment tab 395*a* and the second blank segment tab 395*b* each includes one blank segment void 455, while the third blank segment tab 395*c* includes two segment voids 455. The primary blank segment tab 425*a* and the secondary blank segment tab 425*b* each includes a single blank segment perforated tab 460, while the tertiary blank segment tab 425*c* includes two blank segment perforated tabs 460. However, the invention is not limited to the third blank segment tab 395*c* having two blank segment voids 455 or the tertiary blank segment tab 425*c* having two blank segment perforated tabs 460. The invention is further not limited to the first blank segment tab 395*a* and the second blank segment tab 395*b* each having a single segment void 455 or the primary blank segment tab 425*a* and the secondary blank segment tab 425*b* each having a single blank segment perforated tab 460. In alternative embodiments, the first blank segment tab 395*a*, second blank segment tab 395*b*, and third blank segment tab 395*c* may each include greater or fewer blank segment voids 455. Furthermore, the primary blank segment tab 425*a*, secondary blank segment tab 425*b*, and tertiary blank segment tab 425*c* may each include greater or fewer blank segment perforated tabs 460 as well.

To form the packaging filler insert 20', the first main segment 370 is folded perpendicularly to the second main segment 375 along the first fold line 385. As a result, the first segment 370 is folded at approximately a 90° angle and is therefore generally perpendicular to the second main segment 375. The third main segment 380 is further folded perpendicularly to the second main segment 375 along the second fold line 390. As a result, the third segment 380 is folded at approximately a 90° angle in order to be perpendicular to the second main segment 375 and approximately parallel to the first main segment 370.

The first blank segment tab 395*a*, second blank segment tab 395*b*, and third blank segment tab 395*c* are also folded along the third blank fold line 410, fourth blank fold line 415, and fifth blank fold line 420, respectively. As a result, the first blank segment tab 395*a*, second blank segment tab 395*b*, and third blank segment tab 395*c* are folded at approximately a 90° angle in order to be perpendicular to the first main segment 370, and second blank segment tab 395*b* and third blank segment tab 395*c* are further located opposite from the second main segment 375. The primary blank segment tab 425*a*, secondary blank segment tab 425*b*, and tertiary blank segment tab 425*c* are folded along sixth blank fold line 440, seventh blank fold line 445, and eighth blank fold line 450, respectively. As a result, the primary blank segment tab 425*a*, secondary blank segment tab 425*b*, and tertiary blank segment tab 425*c* are folded at approximately a 90° angle perpendicular to the third main segment 380 and adjacent to the first blank segment tab 395*a*, second blank segment tab 395*b*, and third blank segment tab 395*c*.

Once the blank 365 has been folded, the first main segment 370 becomes the inner packaging filler insert face 325, the second main segment 375 becomes the first packaging filler insert side 310, the third main segment 380 becomes the outer packaging filler insert face 320, the blank segment tabs 395*a* and 425*a* become the second packaging filler end 305, and the blank segment tabs 395*b*, 395*c*, 425*b*, and 425*c* become the second packaging filler insert side 315 as shown in FIG. 11.

In order to secure the blank 365 in its folded form, a second adhesive 462 may be applied to the primary blank segment tab 425*a*, the secondary blank segment tab 425*b*, and the tertiary blank segment tab 425*c*. The second adhesive 462 is configured to adhere the primary blank segment tab 425*a* to the first blank segment tab 395*a*. The second adhesive 462 is also configured to adhere the secondary blank segment tab 425*b* to the second blank segment tab 395*b*, as well as the tertiary blank segment tab 425*c* to the third blank segment tab 395*c*. The adhesive 462 may be used either alone or in conjunction with other means to secure the primary blank segment tab 425*a* to the first blank segment tab 395*a*, the secondary blank segment tab 425*b* to second blank segment tab 395*b*, and the tertiary blank segment tab 425*c* to the third blank segment tab 395*c*, such as, but not limited to, tape, tabs, or staples or other fasteners.

In yet another alternative embodiment, the second adhesive 462 may not be used to secure the blank 365 in its folded form. Instead, blank segment voids 455 may be used in conjunction with the blank segment perforated tabs 460 to secure the blank 365 in its folded packaging filler insert 20' form. The blank segment voids 455 and the blank segment perforated tabs 460 align with each other and are adjacent to each other when the blank segment tabs 395*a*-395*c* and 425*a*-425*c* are folded inwards approximately 90° along their respective fold lines 410-420 and 440-450. The blank segment perforated tabs 460 are folded approximately 90° inwards so that the blank segment perforated tabs 460 are folded into and extend through the blank segment voids 455. As a result, the blank segment perforated tabs 460 are folded inwards and towards the inner packaging filler insert face 325, where the blank segment perforated tabs 460 remain within a cavity 430 (shown in FIG. 11) of the packaging filler insert 20' due to the shape of the blank segment voids 455 and blank segment perforated tabs 460. The blank segment voids 455 and blank segment perforated tabs 460 preferably ensure the packaging filler insert 20' retains its shape and form.

Figure 13:
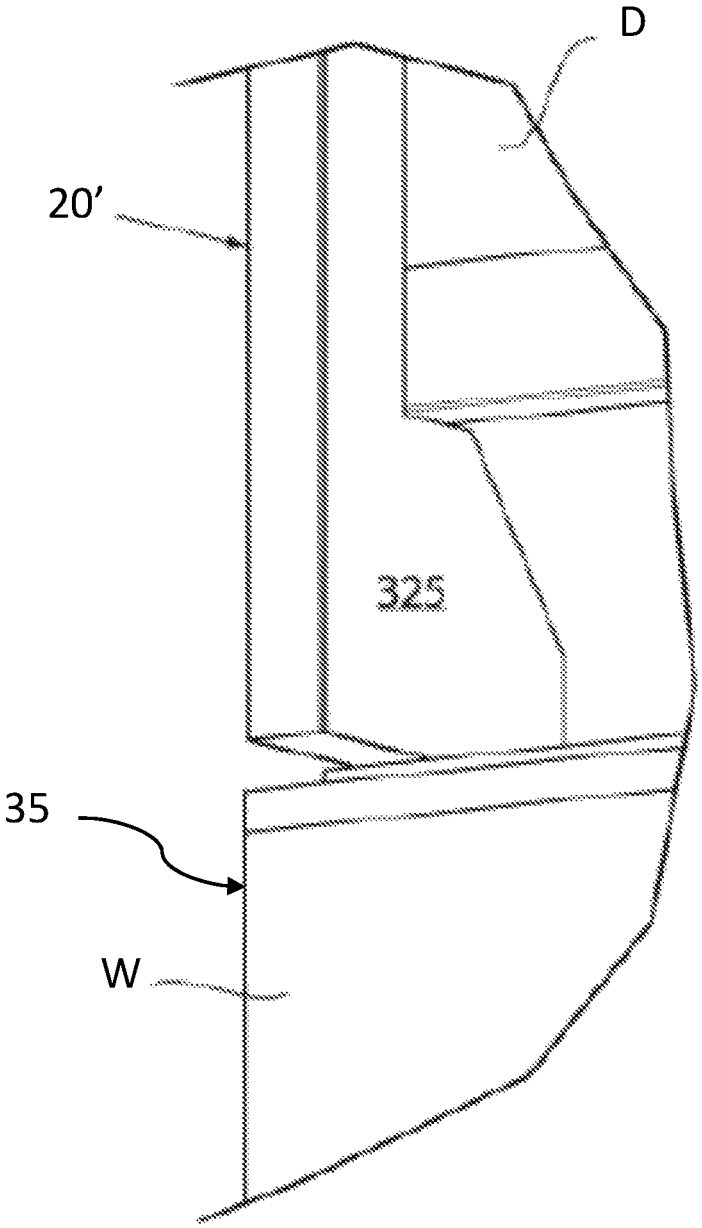
FIG. 13 is a partial perspective view illustrating the second embodiment of the packaging filler insert of FIGS. 8-12 in use.
Figure 14:
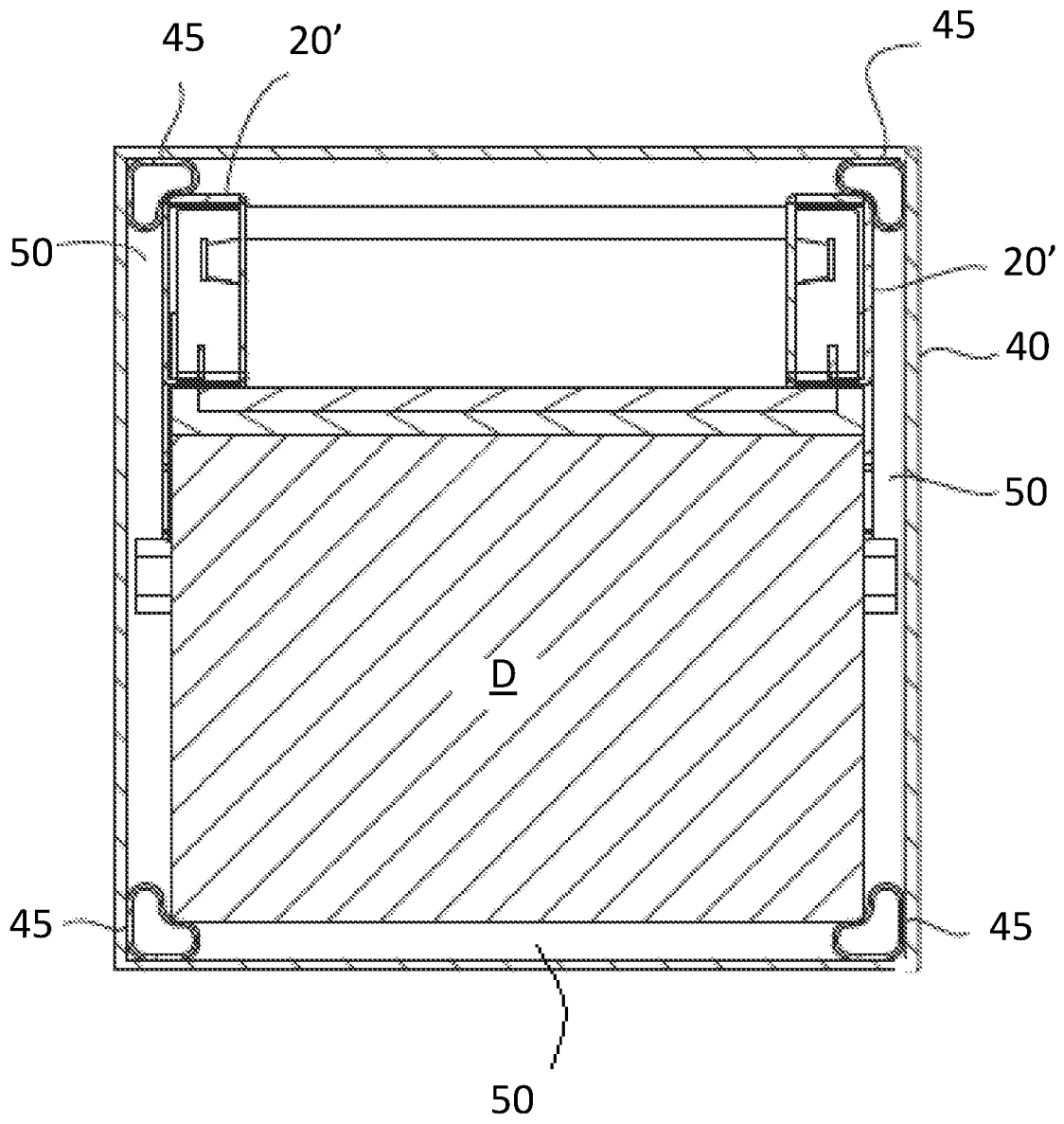
FIG. 14 is a top cross-sectional view of the second embodiment of the packaging filler insert engaged with a stacked washer and dryer unit taken at line 14-14 in FIG. 8.

Once the blank 365 has been formed to create the packaging filler insert 20', the packaging filler insert 20' may be positioned on the product 35. As seen in FIGS. 13 and 14, in embodiments where the product 35 is a stacked washer and dryer unit, the packaging insert filler 5' may be placed in the space 75 between the washer and dryer, shown in FIG. 13. The packaging insert tiller 20' helps protect the product 35 during shipping and also helps support the dryer D to prevent the dryer D from collapsing towards or onto the washer W. Once the packaging insert filler 20' has been placed between the washer W and dryer D, the product 35 can then be placed into the container 40 for shipping, which preferably also includes corner posts 45 located in each corner of the container 40. Once in the container 40, the product 35 is secured so that is generally situated in the center of the container such that its corners (not shown) are adjacent to and contact the corner posts 45 and that gaps 50 are left between the sidewalls of the product 35 and sidewalls of the container. The packaging filler insert 20' retains its positioning within the container 40 between the washer and dryer unit due to its tabs 350 (shown in FIG. 1) abut the sidewall of the product and prevent the packaging filler insert 20' from sliding in the opposite direction. Thus, once packaged, the corner posts 45 prevent the product 35 from abutting the walls of the container 40, as well as shifting within the container 40, while the packaging filler insert 20' functions to provide vertical support from below to the bottom of the dryer unit D from the top of the washer unit W, while at the same time occupying the space forwardly of the front of the dryer unit D to provide horizontal support to the front of the dryer unit D via engagement of the packaging filler inserts 20' with the corner posts 45.

It should be understood that the above description, while indicating representative embodiments of the present invention, is given by way of illustration and not of limitation. Many changes and modifications may be made within the scope of the present invention without departing from the spirit thereof, and the invention includes all such modifications.

Various additions, modifications, and rearrangements are contemplated as being within the scope of the following claims, which particularly point out and distinctly claim the subject matter regarding as the invention, and it is intended that the following claims cover all such additions, modifications, and rearrangements.

I claim:

1. A packaging arrangement; comprising:

a stacked laundry appliance, which includes a lower washer unit and an upper dryer unit, wherein the upper dryer unit is interconnected with and extends upwardly from the lower washer unit and is configured such that a downwardly facing area of the upper dryer unit and an upwardly facing area of the lower washer unit define a void area; and a folded support member positioned within the void area, wherein the folded support member defines a lower end engaged with the lower washer unit at the upwardly facing area and an upper end engaged with the upper dryer unit at the downwardly facing area, wherein the folded support member provides vertical support to the upper dryer unit from the lower washer unit.

2. The packaging arrangement of claim 1, wherein the lower washer unit includes a lower laterally facing surface and the upper dryer unit includes an upper laterally facing surface that is offset from the lower laterally facing surface, and wherein the upper end of the folded support member includes an upper lateral filler section configured to be positioned against the upper laterally facing surface of the upper dryer unit, wherein the upper lateral filler section defines an upwardly extending surface that is coplanar with the lower laterally facing surface of the lower washer unit.

3. The packaging arrangement of claim 2, including first and second spaced apart folded support members.

4. The packaging arrangement of claim 3, wherein the first folded support member is located adjacent a first side of the stacked laundry appliance and the second folded support member is located adjacent a second side of the stacked laundry appliance.

5. The packaging arrangement of claim 4, wherein the first and second folded support members include tabs that engage respective first and second sides of the stacked laundry appliance, wherein the tabs are configured to maintain the first and second folded support members in position at the first and second sides, respectively, of the stacked laundry appliance.

6. The packaging arrangement of claim 2, further comprising a shipping carton defining an interior configured to receive the stacked laundry appliance with the folded support member positioned between the upper dryer unit and the lower washer unit.

7. The packaging arrangement of claim 6, wherein the shipping container includes a series of walls defining a series of corners, and wherein the packaging arrangement comprises first and second spaced apart folded support members, wherein the first and second folded support members are positioned adjacent first and second corners, respectively, of the shipping container.

8. The packaging arrangement of claim 7, further comprising first and second L-shaped corner reinforcement members positioned in the first and second corners, respectively, of the shipping container, wherein the first and second corner reinforcement members are positioned between the first and second corners of the shipping container and the first and second spaced apart folded support members, respectively.

9. The packaging arrangement of claim 8, wherein the lower washer unit defines first and second corners that are engaged with the first and second corner reinforcement members, respectively.

10. A method of providing support for a stacked laundry appliance, which includes a lower washer unit and an upper dryer unit, wherein the upper dryer unit is interconnected with and extends upwardly from the lower washer unit and is configured such that a downwardly facing area of the upper dryer unit and an upwardly facing area of the lower washer unit define a void area, comprising providing a folded support member defining a lower end and an upper end, and positioning the folded support member such that the lower end of the folded support member engages the lower washer unit at the upwardly facing area and the upper portion of the folded support member engages the upper dryer unit at the downwardly facing area, wherein the folded support member provides vertical support to the upper dryer unit from the lower washer unit.

11. The method of claim 10, wherein the lower washer unit includes a lower laterally facing surface and the upper dryer unit includes an upper laterally facing surface that is offset from the lower laterally facing surface, and wherein the upper end of the folded support member includes an upper lateral filler section, wherein the upper lateral filler section is positioned against the upper laterally facing surface of the upper dryer unit and defines an upwardly extending surface that is generally coplanar with the lower laterally facing surface of the lower washer.

12. The method of claim 11, wherein the step of providing a folded support member comprises providing first and second folded support members and positioning the first and second in spaced apart relationship.

13. The method of claim 11, including positioning the first folded support member adjacent a first side of the stacked washer and dryer unit, and positioning the second folded support member adjacent a second side of the stacked washer and dryer unit.

14. The method of claim 13, wherein the first and second folded support members include tabs, and including the step of engaging the tabs with respective first and second sides of the stacked washer and dryer unit, wherein the tabs maintain the first and second folded support members in position at the first and second sides, respectively, of the stacked washer and dryer unit.

15. The method of claim 10, further comprising the steps of providing a shipping carton defining an interior, and placing the stacked washer and dryer unit into the shipping carton with the folded support member positioned between the upper dryer unit and the lower washer unit.

16. The method of claim 15, wherein the shipping container includes a series of walls defining a series of corners, and wherein the step of providing a folded support member comprises providing first and second folded support members and positioning the first and second in spaced apart relationship such that the first and second folded support members are positioned adjacent first and second corners, respectively, of the shipping container.

17. The method of claim 16, further comprising the step of providing first and second L-shaped corner reinforcement members and positioning the first and second corner reinforcement members in the first and second corners, respectively, of the shipping container such that the first and second corner reinforcement members are positioned between the first and second corners of the shipping container and the first and second spaced apart folded support members, respectively.

18. The method of claim 17, wherein the lower portion of the stacked washer and dryer unit defines first and second corners, and including the step of engaging the first and second corners with the first and second corner reinforcement members, respectively.

19. The method of claim 10, wherein the step of providing a folded support member is carried out by forming the folded support member from a blank, wherein the blank includes first and second panels which form parallel sidewalls when the blank is folded to form the folded support member; a third panel located between the first and second panels that forms a first end wall between the parallel sidewalls when the blank is folded to form the folded support member; a fourth panel extending from the first panel opposite the third panel; a fifth panel extending from the second panel opposite the third panel; and a tab-type engagement arrangement that interconnects the fourth and fifth panels to form a second end wall between the parallel sidewalls when the blank is folded to form the folded support member.

* * * * *